United States Patent [19]

Johnson

[11] Patent Number: 4,899,967

[45] Date of Patent: Feb. 13, 1990

[54] PORTABLE FLEXIBLE BAG HOLDER

[76] Inventor: Austin E. Johnson, 6800 W. 16th Ave., Lakewood, Colo. 80215

[21] Appl. No.: 297,107

[22] Filed: Jan. 17, 1989

[51] Int. Cl.[4] ..... A63B 55/04

[52] U.S. Cl. ..... 248/97; 248/99

[58] Field of Search ..... 248/95–101

[56] References Cited

U.S. PATENT DOCUMENTS

| | | | |
|---|---|---|---|
| 575,902 | 1/1897 | Nicholas | 248/97 |
| 1,858,649 | 5/1932 | Weakley | 248/97 |
| 3,893,649 | 7/1975 | Cornell et al. | 248/101 |
| 4,283,032 | 8/1981 | Smith | 248/101 X |
| 4,488,697 | 12/1984 | Garvey | 248/97 X |
| 4,562,983 | 1/1986 | Klerfbeck | 248/97 |
| 4,572,251 | 2/1986 | Drury | 248/97 X |
| 4,667,911 | 5/1987 | Farris et al. . | |
| 4,759,518 | 7/1988 | Yardas | 248/97 |

*Primary Examiner*—Alvin C. Chin-Shue

*Attorney, Agent, or Firm*—Klaas & Law

[57] ABSTRACT

A readily assembled and disassembled portable flexible bag holder comprising an annular member having an annular recess formed in its outer peripheral surface and a partially inflated air impervious flexible annular tubular member seated in the annular recess and having an annular contacting relationship therewith. A plurality of arcuate members are provided for contacting a portion of the open end portion of a flexible bag that has been stretched over the annular member and the air impervious flexible annular tubular member. A plurality of clamps are provided to urge each of the arcuate members in radially inward directions to clamp a portion of the open end portion of the flexible bag between each of the arcuate members and a radially opposite portion of the air impervious flexible tubular annular member. A leg is removably secured to each of the arcuate members for holding the open end portion of the flexible bag a distance above a support surface.

20 Claims, 2 Drawing Sheets

FIG 3
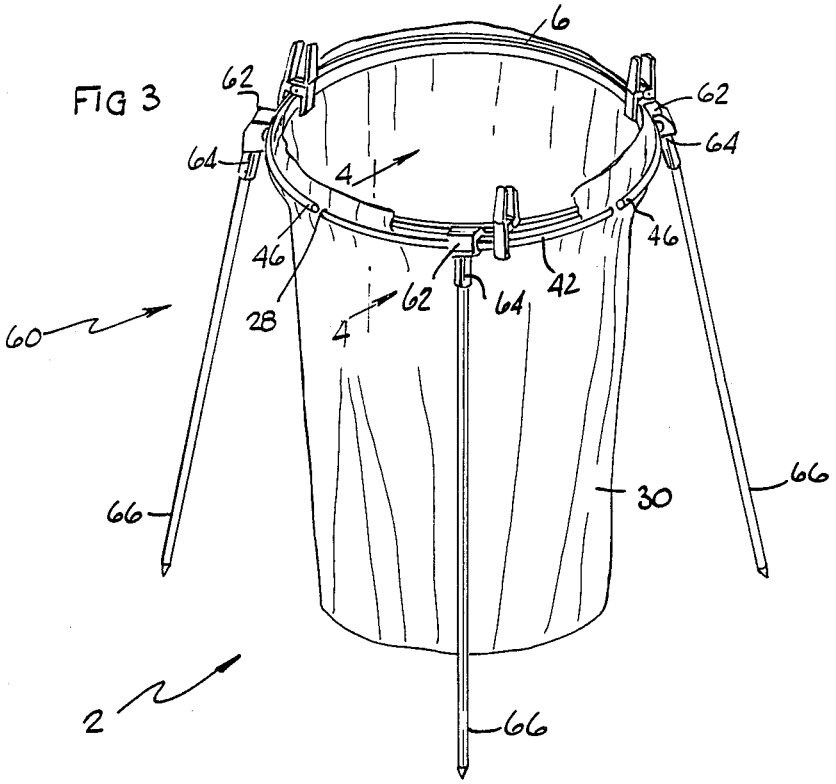
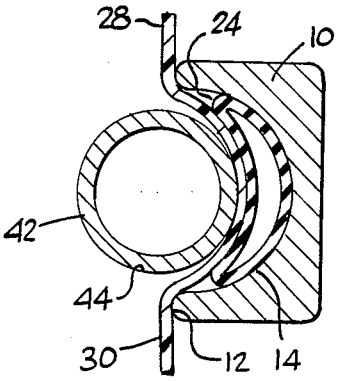
FIG. 4
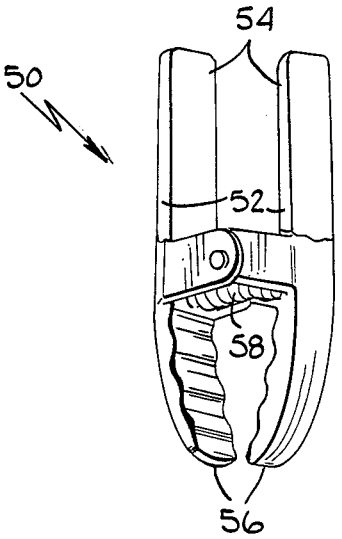
FIG. 5

PORTABLE FLEXIBLE BAG HOLDER

FIELD OF THE INVENTION

This invention relates generally to the field of flexible bag holders and more particularly to the field of portable flexible bag holders.

BACKGROUND OF THE INVENTION

The flexible plastic bag has more or less become the most widely used receptacle for use in lawn maintenance, trash and other various uses. In one method of use, the flexible plastic bag is inserted into a rigid container, much like a liner, and the open end of the flexible bag is folded down over the side wall of the container. When the flexible bag is filled, it is removed from the container, the open end is folded together and tied and eventually discarded. One problem encountered with the use of rigid container occurs when the container is to be used at a remote location that may require some type of a vehicle to transport it. If the container is relatively large, difficulties can arise in transporting it to another location. In U.S. Pat. No. 4,667,911, there is illustrated a different type of support for a flexible bag in which a plurality of legs are fixedly mounted on a ring so as to support the ring at a distance above a support surface. The lower portions of the legs extend radially outwardly so as to provide a large space for the bag to expand. The open end of the flexible bag is passed through the inner surface of the ring and then folded down over the outer surface of the ring. An elastic band is put around the flexible bag to urge it against the outer surface of the ring. This type of support still has the transportation problem and deterioration of the elastic band will permit the flexible bag to slip therethrough.

BRIEF DESCRIPTION OF THE INVENTION

This invention provides a readily assembled or disassembled flexible plastic bag holder that can easily be moved from one location to another distant location to be used to collect objects, such as leaves, and which has a positive locking feature to retain the flexible plastic bag in place when in use.

In a preferred embodiment of the invention, the portable flexible bag holder comprises an annular member having inner and outer peripheral surfaces. The outer peripheral surface has two spaced apart rim portions integral with a central body portion which extends radially inwardly from the spaced apart rim portions so as to form an annular recess. An air impervious flexible annular tubular member is positioned in the annular recess and is partially inflated with a sufficient amount of air to form an annular cavity therein, with the air impervious flexible annular tubular member having inner and outer peripheral surfaces. The oppositely facing surfaces of the central body portion and the air impervious flexible annular tubular member have an annular contacting relationship. Clamping means are provided for contacting the open end portion of a flexible bag, preferably formed from a thin plastic material, such as polyethylene, that has been stretched over the annular member and the air impervious flexible annular tubular member. The clamping means preferably comprise at least three arcuate members, each having a center of curvature defining a longitudinal axis and inner and outer peripheral surfaces with the inner peripheral surface having a radius of curvature that is less than the radius of curvature of the rim portions and less than the radius of curvature of the outer peripheral surface of the partially inflated air impervious flexible annular tubular member. The radius of curvature of the outer peripheral surface of the partially inflated air impervious flexible tubular member is less than the radius of curvature of the rim portions. Force applying means are provided for applying radially inwardly directed forces on each of the arcuate members so as to clamp a portion of the open end portion of the flexible bag between the inner peripheral surface of the arcuate member and the oppositely facing portion of the outer peripheral surface of the partially inflated air impervious flexible annular tubular member. The force applying means preferably comprise a clamp for each of the arcuate members with each clamp having gripping end portions resiliently urged together. Support means are provided for supporting the annular member a distance above a support surface and comprise a head portion secured to the outer peripheral surface of each of the arcuate members and a stem portion extending in an axial direction to form an acute included angle with the longitudinal axis of the arcuate member. A leg is removably secured in each of the stem portions so as to hold the open end portion of the flexible bag a distance above a support surface.

BRIEF DESCRIPTION OF THE DRAWINGS

An illustrative and presently preferred embodiment of the invention is shown in the accompanying drawings in which:

FIG. 3 is a perspective view of an assembled flexible bag holder supporting a flexible bag;

FIG. 4 is a cross-sectional view taken on the line 4—4 of FIG. 3; and FIG. 5 is a perspective view of one of the clamps.

DETAILED DESCRIPTION OF THE INVENTION

Figure 1:
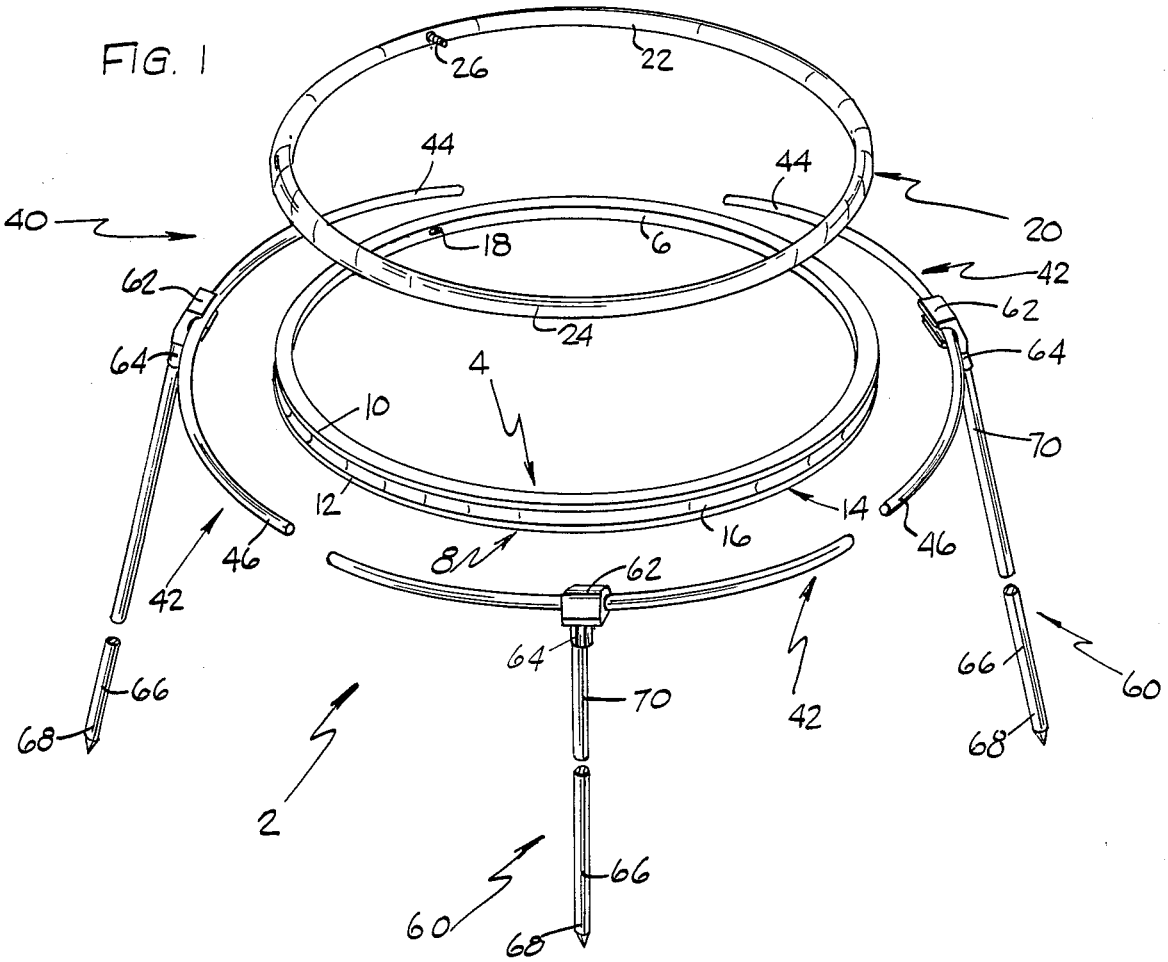
FIG. 1 is an exploded perspective view of various components of the preferred embodiment of the invention.

The preferred embodiment of the invention is illustrated in FIGS. 1–4 and comprises a flexible bag holder 2 comprising an annular member 4 having an inner peripheral surface 6 nd an outer peripheral surface 8. The outer peripheral surface 8 has two spaced apart rim portions 10 and 12 integral with a central body portion 14 which extends radially inwardly from the rim portions 10 and 12 so as to form an annular recess 16. In the preferred embodiment, the annular member 4 comprises a bicycle wheel rim having a twenty-one inch diameter. The annular member 4 has an opening 18 extending through the central body portion 14, for purposes described below.

Figure 2:
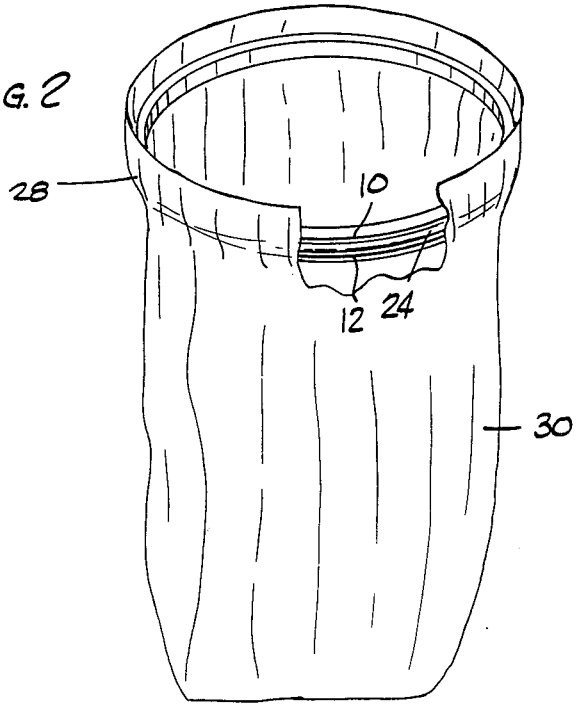
FIG. 2 perspective view of a partial assembly of some of the components.

An air impervious flexible annular tubular member 20 is provided and has an inner peripheral surface 22 and an outer peripheral surface 24. The air impervious flexible annular tubular member 20 has a valve means 26 so that air may be pumped into or withdrawn from the air impervious flexible annular tubular member 20. As illustrated in FIG. 2, the air impervious flexible annular tubular member 20 is positioned around the central body portion 14 so that the oppositely facing portions of the central body portion 14 and the inner peripheral surface 22 of the air impervious flexible annular tubular member have an annular contacting relationship. The inner peripheral surface 22 has an inner peripheral extent before it is positioned on the central body portion 14 that is less than the outer peripheral extent of the portion of the central body portion 14 that it contacts to ensure the above-described annular contacting relationship. When assembling the air impervious annular tubular member 20 on the central body portion 14, the valve means 26 is inserted through the opening 18 and the air impervious flexible annular tubular member 20 is stretched over one of the rim portions 10 or 12. After the air impervious flexible annular tubular member 20 has been positioned on the central body portion 14, a conventional pump (not shown) is used to partially inflate the air impervious flexible annular tubular member 20 with between about 0.5 and 3 ounces of air and preferably of about 1.5 ounces of air. In the preferred embodiment, the air impervious flexible annular tubular member 20 comprises a standard 20×1.75 inch conventional bicycle tire tube. The open end portion 28 of a flexible bag 30 is stretched over the rim portions 10 and 12, as illustrated in FIG. 2, so that an annular portion thereof is radially opposite to the air impervious flexible annular tubular member 20 and is ready to be clamped in position as described below. If desired, the open end portion 28 of a flexible bag 30 may be inserted through the inner peripheral surface 6 of the annular member 4 and then stretched back over the rim portions 10 and 12 of the annular member 4 so as to cover the air impervious flexible annular tubular member 20. If the diameter of the flexible bag 30 is larger than the diameter of the rim portions 10 and 12, it will be only folded back over the rim portions.

Clamping means 40 are provided for contacting the portion of the open end portion 28 covering the air impervious flexible annular tubular member 20. The clamping means 40 comprises a plurality of arcuate members 42, which in the preferred embodiment are three in number, each having a center of curvature defining a longitudinal axis and an inner peripheral surface 44 and an outer peripheral surface 46. Each inner peripheral surface 44 has a radius of curvature that is less than the radius of curvature of each of rim portions 10 and 12 and less than the radius of curvature of the outer peripheral surface 24 of the partially inflated air impervious flexible annular tubular member 20. The radius of curvature of the outer peripheral surface 24 is less than the radius of curvature of each of the rim portions 10 and 12. Each of the arcuate members 42 is adapted to be positioned so that the inner peripheral surface 44 thereof is in contact with the portion of the open end portion 28 of the flexible bag 30 that is radially opposite to an arcuate portion of the outer peripheral surface 24 when the air impervious flexible annular tubular member 20 is in position on the central body portion 14.

Force applying means 50 are provided for applying radially inwardly directed forces on each of the arcuate members 42 when they are positioned in contact with the portion of the open end portion 28 that is radially opposite to an arcuate portion of the outer peripheral surface 24 of the air impervious flexible annular tubular member 20. The force applying means 50 comprise a pair of levers 52 having handle ends 54 and gripping ends 56. A spring 58 is mounted between the handle ends 54 to urge them apart and to urge the gripping ends 56 together.

Support means 60 are provided for supporting the annular member a distance above a support surface. The support means 60 comprise a head portion 62 secured to the outer peripheral surface 46 of each of the arcuate members 42. Each of the head portions 62 has a stem portion 64. As illustrated in FIGS. 1 and 3, each stem portion 64 extends in an axial direction to form an acute included angle with the longitudinal axis of each arcuate member 42. An elongated leg 66 is provided for each of the stem portions 64. Each leg 66 is secured to each stem portion 64 by suitable means such as an externally threaded end portion on each leg 66 which is threadedly engaged in an internally threaded opening in each stem portion 64.

The portable flexible bag holder is assembled by placing the valve means 26 through the opening 18 and stretching the air impervious flexible annular tubular member 20 over one of the rim portions 10 and 12 so that the inner peripheral surface 22 thereof is in annular contacting relationship with a portion of the central body portion 14. The air impervious flexible annular member 20 is then partially inflated with about 1.5 ounces of air. The open end portion 28 of a flexible bag 30 is then stretched over the rim portions 10 and 12 so that a portion thereof covers the outer peripheral surface 24 of the air impervious flexible tubular annular member 20. The inner peripheral surface 44 of each arcuate member 42 is successively placed in contact with the portion of the open end portion 28 that is radially opposite to the outer peripheral surface 24 and a force applying means 50 is attached thereto to clamp the open end portion 28 firmly in place. As illustrated in FIG. 4, the inner peripheral surface 44 has pushed the open end portion 28 and the outer peripheral surface 24 radially inwardly so that the open end portion 28 is firmly gripped and will not move. An elongated leg 66 is then inserted into each of stem portions 64 to support the open end 28 a distance above a support surface. As illustrated in FIGS. 1 and 3, each leg 66 extends in an axial direction to form an acute angle with longitudinal axis of the arcuate member 42 so that the bottom portions 68 of the legs are located the greatest radial distance from such longitudinal axis.

While an illustrative and presently preferred embodiment of the invention has been described in detail herein, it is to be understood that the inventive concepts may be otherwise variously embodied and employed and that the appended claims are intended to be construed to include such variations except insofar as limited by the prior art.

What is claimed is:

1. Apparatus for holding a flexible bag comprising:

an annular member having an inner and an outer peripheral surface;

said outer peripheral surface comprising two spaced apart rim portions integral with a central body portion;

said central body portion extending radially inwardly from said rim portions to form an annular recess;

an air impervious flexible annular tubular member positioned in said annular recess and is at least partially inflated with a sufficient amount of air to form an annular cavity therein and said air impervious flexible annular tubular member having inner and outer peripheral surfaces so that the open end portion of a flexible bag may be passed through said annular member and be folded back over said annular member so that an annular portion thereof is radially outwardly opposite to said air impervious flexible annular tubular member;

clamping means for contacting said annular portion of said open end portion of said flexible bag so that said annular portion is located between said air impervious flexible annular tubular member and said clamping means;

force applying means for applying radially inwardly directed forces on said clamping means so as to clamp said annular portion of said open end portion of said flexible bag between said clamping means and said outer peripheral surface of said air impervious flexible annular tubular member; and support means for holding said open end portion of said flexible bag at a relatively fixed position spaced a distance above a support surface and the bottom closed end of said flexible bag.

2. Apparatus as in claim 1 wherein:

said flexible bag is stretched over said rim portions.

3. Apparatus as in claim 2 and further comprising:

said air impervious flexible annular tubular member having an inner peripheral extent prior to being positioned on said central body portion that is less than the peripheral extent of said central body portion.

4. Apparatus as in claim 1 wherein:

said air impervious flexible annular tubular member having an inner peripheral extent prior to being positioned on said central body portion that is less than the peripheral extent of said central body portion.

5. Apparatus as in claim 1 wherein:

said annular member comprises a bicycle wheel rim.

6. Apparatus as in claim 5 wherein:

said air impervious flexible member comprises a bicycle inner tube.

7. Apparatus as in claim 6 wherein:

said air impervious flexible annular tubular member having an inner peripheral extent prior to being positioned on said central body portion that is less than the peripheral extent of said central body portion.

8. Apparatus as in claim 7 wherein:

said bicycle wheel rim has a diameter of twenty-one inches; and said inner tube is a $20\times1.75$ inch inner tube.

9. Apparatus as in claim 1 wherein said clamping means comprises:

at least two arcuate members each having an inner radius of curvature that is less than the radius of curvature of each of said rim portions and less than the outer radius of curvature of said outer peripheral surface of said at least partially inflated air impervious flexible annular tubular member.

10. Apparatus as in claim 9 wherein said force applying means comprises:

at least two clamps;

each of said clamps comprising two elongated members having opposite end portions and pivotally connected together at a location between said opposite end portions;

one of said opposite end portions comprising a pair of gripping members;

the other of said opposite end portions comprising a pair of handle members; and resilient means urging said handle members apart so as to urge said gripping members together.

11. Apparatus as in claim 10 wherein:

each of said arcuate members having an arcuate extent of 180 degrees.

12. Apparatus as in claim 1 wherein said clamping means comprises:

at least three arcuate members each having a center of curvature forming a longitudinal axis and an inner radius of curvature that is less than the radius of curvature of each of said rim portions and less than the radius of curvature of said outer peripheral surface of said at least partially inflated air impervious flexible annular tubular member.

13. Apparatus as in claim 12 wherein:

said radius of curvature of each of said rim portions being greater than said radius of curvature of said outer peripheral surface of said at least partially inflated air impervious flexible annular tubular member.

14. Apparatus as in claim 12 wherein:

each of said arcuate members comprising a relatively rigid member having an annular transverse cross-sectional configuration.

15. Apparatus as in claim 14 and further comprising:

each of said arcuate members having inner and outer peripheral surfaces;

connecting means having a head portion secured to a portion of said outer peripheral surface of each of said annular members;

said connecting means having a stem portion extending in a direction to form an acute angle with said longitudinal axis of each of said arcuate members; and removable securing means for removably securing one of said legs on said stem portion.

16. Apparatus as in claim 15 wherein:

said flexible bag is stretched over said rim portions.

17. Apparatus as in claim 14 wherein:

each of said arcuate members having an arcuate extent of 120 degrees.

18. Apparatus in claim 14 wherein:

said air impervious flexible, annular tubular member having an inner peripheral extent prior to being positioned on said central body portion that is less than the peripheral extent of said central body portion.

19. Apparatus as in claim 18 wherein:

each of said arcuate members comprising a relatively rigid member having an annular transverse cross-sectional configuration.

20. Apparatus as in claim 19 wherein said force applying means comprises:

at least three clamps;

each of said clamps comprising two elongated members having opposite end portions and pivotally connected together at a location between said opposite end portions;

one of said opposite end portions comprising a pair of gripping members;

the other of said opposite end portions comprising a pair of handle members; and resilient means urging said handle members apart so as to urge said gripping members together.

* * * * *